US010964242B2

(12) United States Patent
Wang

(10) Patent No.: US 10,964,242 B2
(45) Date of Patent: Mar. 30, 2021

(54) POWER-OFF DISCHARGING CIRCUIT AND RELEVANT METHOD, DRIVING CIRCUIT AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventor: Zheng Wang, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 145 days.

(21) Appl. No.: 16/328,101

(22) PCT Filed: Aug. 13, 2018

(86) PCT No.: PCT/CN2018/100181

§ 371 (c)(1),
(2) Date: Feb. 25, 2019

(87) PCT Pub. No.: WO2019/080600

PCT Pub. Date: May 2, 2019

(65) Prior Publication Data

US 2020/0357317 A1 Nov. 12, 2020

(30) Foreign Application Priority Data

Oct. 27, 2017 (CN) ..... 201711022564.5

(51) Int. Cl.
*G09G 3/20* (2006.01)

(52) U.S. Cl.
CPC ..... *G09G 3/20* (2013.01); *G09G 2330/023* (2013.01); *G09G 2330/027* (2013.01)

(58) Field of Classification Search
CPC ..... G09G 3/3677; G09G 2310/0243; G09G 2310/0286; G09G 2310/06; G09G 3/36;
(Continued)

(56) References Cited

U.S. PATENT DOCUMENTS 5,945,970 A * 8/1999 Moon ..... G09G 3/3648 345/211
2003/0076149 A1 4/2003 Haga
(Continued)

FOREIGN PATENT DOCUMENTS

CN 102855839 A 1/2013
CN 102903346 A 1/2013
(Continued)

OTHER PUBLICATIONS

First Office Action and English language translation, CN Application No. 201711022564.5, dated Apr. 22, 2019, 24 pp.
(Continued)

*Primary Examiner* — Md Saiful A Siddiqui
(74) *Attorney, Agent, or Firm* — Myers Bigel, P.A.

(57) ABSTRACT

The present disclosure relates to a power-off discharging circuit including a control circuit, an energy storage circuit and a switching circuit. An input terminal of the control circuit is coupled to a control signal terminal, and an output terminal is coupled to a first terminal of the energy storage circuit. A second terminal of the energy storage circuit is coupled to a first terminal of the switching circuit, of which a second terminal and a third terminal are coupled to a pull-up node and a first power supply voltage terminal of a gate driving circuit respectively. The control circuit controls charging and discharging of the energy storage circuit based on a control signal input on the control signal terminal when an Xon function is enabled. The switching circuit is configured to conductively connect or disconnected the pull-up
(Continued)

node and the first power supply voltage terminal via charging or discharging.

18 Claims, 8 Drawing Sheets

(58) Field of Classification Search
CPC ..... G09G 3/3685; G09G 2300/0417; G09G 2310/08; G09G 3/3674; G09G 2330/021; G09G 3/20; G09G 2330/023; G09G 2330/027
See application file for complete search history.

(56) References Cited

U.S. PATENT DOCUMENTS

| | | | | |
|---|---|---|---|---|
| 2010/0097360 | A1 | 4/2010 | Cho et al. | |
| 2010/0182305 | A1* | 7/2010 | Fang | G09G 3/3677 345/212 |
| 2014/0085289 | A1 | 3/2014 | Liang et al. | |
| 2015/0302934 | A1 | 10/2015 | Qi et al. | |
| 2018/0025687 | A1 | 1/2018 | Wang | |

FOREIGN PATENT DOCUMENTS

| | | | |
|---|---|---|---|
| CN | 103034006 | A | 4/2013 |
| CN | 103996367 | A | 8/2014 |
| CN | 105976755 | A | 9/2016 |
| CN | 106157920 | A | 11/2016 |
| CN | 106486085 | A | 3/2017 |
| CN | 106531116 | A | 3/2017 |
| CN | 107564491 | A | 1/2018 |
| JP | 10-282471 | A | 10/1998 |
| KR | 10-2010-0042329 | A | 4/2010 |

OTHER PUBLICATIONS

International Search Report and Written Opinion of the International Searching Authority (with English language translation of Written Opinion), International Application No. PCT/CN2018/100181, dated Nov. 12, 2018, 12 pp.

* cited by examiner

POWER-OFF DISCHARGING CIRCUIT AND RELEVANT METHOD, DRIVING CIRCUIT AND DISPLAY DEVICE

CROSS REFERENCE TO RELATED APPLICATIONS

The present application is a 35 U.S.C. 371 national stage application of PCT International Application No. PCT/CN2018/100181, filed on Aug. 13, 2018, which claims the benefit of Chinese Patent Application No. 201711022564.5 filed on Oct. 27, 2017, the contents of which are incorporated herein by reference in their entireties.

FIELD

The present disclosure relates to the field of displays, particularly to a power-off discharging circuit and relevant method, driving circuit and display device.

BACKGROUND

Normally, LCD liquid crystal displays all have a power-on/off operation, that is, there will be a corresponding power-on/off process in their relevant control driving circuits. If there is a problem with circuit timing during the power-on/off process, it may probably affect the display effect of the LCDs. In a product using a panel design with GOA (gate on array) gate driver structure, a power-off voltage change function of an Xon function is generally used to make all gate drivers output at a high level, so as to solve problems such as the power-off "afterimage". However, after the Xon function ends and when power-on is performed again in a short period of time, since residual charges in the circuit structure are not completely released, timing abnormity is extremely likely to occur at the moment of power-on.

The so-called Xon function is a function that pulls up all of the signals in the circuits within a short period of time at the moment of power-down, causing all of gate drivers to be at high potential together, thereby eliminating the power-off afterimage. Usually, after the Xon function ends, all transistors should be in an off state. However, since the pull-up node in a GOA unit is coupled to a capacitor, the pull-up node is maintained at a high potential due to the charging function of the capacitor in a short period of time. As such, when the panel is turned on again and signals are input again, the un-reset pull-up node is extremely easily to be coupled to a clock signal, thereby generating an erroneous gate output and affecting the display effect of the display eventually.

SUMMARY

In a first aspect of the present disclosure, a power-off discharging circuit is provided, which comprises a control circuit, an energy storage circuit, and a switching circuit. An input terminal of the control circuit is coupled to a control signal terminal. An output terminal of the control circuit is coupled to a first terminal of the energy storage circuit. A second terminal of the energy storage circuit is coupled to a first terminal of the switching circuit. A second terminal of the switching circuit is coupled to a pull-up node of a gate driving circuit. A third terminal of the switching circuit is coupled to a first power supply voltage terminal of the gate driving circuit. The control circuit is configured to control the charging and discharging of the energy storage circuit based on a control signal input on the control signal terminal when an Xon function is enabled. The energy storage circuit is configured to control the second terminal and the third terminal of the switching circuit to be conductively-connected or disconnected correspondingly via the charging or discharging. The switching circuit is configured to receive control of the energy storage circuit through the first terminal such that the pull-up node and the first power supply voltage terminal are conductively-connected or disconnected via the charging or discharging of the energy storage circuit.

Optionally, the control circuit comprises a switching sub-circuit. A first terminal of the switching sub-circuit and a third terminal of the energy storage circuit are both coupled to the first power supply voltage terminal. A second terminal of the switching sub-circuit is coupled to the first terminal of the energy storage circuit. The control circuit is further configured to control the conductive connection or disconnection of the first terminal and the second terminal of the switching circuit based on the control signal, and when the switching sub-circuit is turned on, control the energy storage circuit to charge if the first power supply voltage terminal is at a high potential, and control the energy storage circuit to discharge if the first power supply voltage terminal is at a low potential.

Optionally, the first power supply voltage terminal changes to a low potential after the Xon function ends, and the energy storage circuit is configured to not conductively-connect the second terminal and the third terminal of the switching circuit via the stored electrical energy until the Xon function ends.

Optionally, the control signal terminal is coupled to any one of a signal line terminal in the gate driving circuit, an output terminal of a GOA unit, and a preset control signal terminal.

Optionally, the switching circuit comprises a discharge thin film transistor. A first electrode of the discharge thin film transistor is coupled to the pull-up node, a second electrode of the discharge thin film transistor is coupled to the first power supply voltage terminal, and a gate of the discharge thin film transistor is coupled to the second terminal of the energy storage circuit. The first electrode of the discharge thin film transistor is a source or a drain, and the second electrode of the discharge thin film transistor is a drain or a source corresponding to the first electrode.

Optionally, the energy storage circuit includes an energy storage capacitor. A first terminal of the energy storage capacitor is coupled to the first power supply voltage terminal, and a second terminal of the energy storage circuit is coupled to the first terminal of the switching circuit and the output terminal of the control circuit.

Optionally, the energy storage capacitor has a capacitance value of 10 fF~9000 fF.

Optionally, the control circuit comprises a control thin film transistor. A first electrode of the control thin film transistor is coupled to the first power supply voltage terminal; a second electrode of the control thin film transistor is coupled to the first terminal of the energy storage circuit; a gate of the control thin film transistor is coupled to the control signal terminal and controls to turn on upon receiving a control signal from the control signal terminal. The first electrode of the control thin film transistor is a source or a drain, and the second electrode of the control thin film transistor is a drain or a source corresponding to the first electrode.

Optionally, the control circuit further includes an auxiliary thin film transistor. A first electrode of the auxiliary thin film transistor and a gate of the auxiliary thin film transistor are both coupled to the first power supply voltage terminal; a second electrode of the auxiliary thin film transistor is coupled to the first terminal of the energy storage circuit. The first electrode of the auxiliary thin film transistor is a source or a drain, and the second electrode of the auxiliary thin film transistor is a drain or a source corresponding to the first electrode.

Optionally, the potential of the first power supply voltage terminal is configured to be pulled to an active potential when the Xon function is enabled, so as to charge the energy storage circuit when the control thin film transistor is turned on, and configured to return to an inactive potential when the Xon function ends so as to discharge the energy storage circuit when the control thin film transistor is turned on.

Optionally, the potential of the first power supply voltage terminal is configured to be pulled to an active potential when the Xon function is enabled, so as to charge the energy storage circuit when the auxiliary thin film transistor is turned on.

In a second aspect of the present disclosure, a method of discharging via a power-off discharging circuit is also provided. The power-off discharging circuit comprises a control circuit, an energy storage circuit and a switching circuit. An input terminal of the control circuit is coupled to a control signal terminal. An output terminal of the control circuit is coupled to a first terminal of the energy storage circuit. A second terminal of the energy storage circuit is coupled to a first terminal of the switching circuit. A second terminal of the switching circuit is coupled to a pull-up node of a gate driving circuit. A third terminal of the switching circuit is coupled to a first power supply voltage terminal of the gate driving circuit. The method comprises: controlling the charging or discharging of the energy storage circuit based on a control signal input on the control signal terminal of the control circuit when an Xon function is enabled; and controlling conductive connection or disconnection of the second terminal and the third terminal of the switching circuit via the charging or discharging of the energy storage circuit, so that the pull-up node and the first power supply voltage terminal are conductively-connected or disconnected.

Optionally, the control signal is any one of signals on a signal line terminal in the gate driving circuit, an output terminal of the GOA unit, and a signal on a preset control signal terminal.

Optionally, the first power supply voltage terminal changes to an inactive potential after the Xon function ends, and the energy storage circuit do not make the second terminal and third terminal of the switching circuit be conductively-connected via stored electrical energy until the Xon function ends.

In a third aspect of the present disclosure, a gate driver is provided. The gate driver comprises: a GOA unit; and the power-off discharging circuit according to the preceding text. The second terminal of the switching circuit of the discharging circuit is coupled to the pull-up node of the GOA unit, and the third terminal of the switching circuit is coupled to the first power supply voltage terminal of the GOA unit.

Optionally, the gate driver comprises N cascaded GOA units. The N GOA units are the first GOA unit to the $N^{th}$ GOA unit; wherein N is an integer greater than or equal to 2.

Optionally, for the cascaded N GOA units, a signal input terminal of the first GOA unit is coupled to a frame start signal, and a reset signal terminal of the $N^{th}$ GOA unit is coupled to the frame start signal; a signal input terminal of each of the second GOA unit to the $N^{th}$ GOA unit is coupled to an output terminal of an upper-stage GOA unit adjacent thereto. A reset signal terminal of each of the first GOA unit to the $N-1^{th}$ GOA unit is coupled to an output terminal of a next-stage GOA unit adjacent thereto.

Optionally, each GOA unit in the N GOA units is coupled to a corresponding power-off discharging circuit. The control signal terminal of the power-off discharging circuit coupled to the $i^{th}$ GOA unit is the output terminal of the $i-2^{th}$ GOA unit; wherein i takes a value 3~N. The control signal terminals of the power-off discharging circuits coupled to the first GOA unit and the second GOA unit are coupled to a signal line terminal, any GOA output terminal or a preset control signal terminal.

Optionally, each GOA unit in the N GOA units is coupled to a same power-off discharging circuit. The control signal terminal of the power-off discharging circuit is a signal line terminal, any one of output terminals of the GOA units or a preset control signal terminal.

In a fourth aspect of the present disclosure, a display device is provided. The display device comprises the gate driver as described above.

BRIEF DESCRIPTION OF DRAWINGS

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

The present disclosure will be further described in detail below in conjunction with specific embodiments and with reference to accompanying drawings, to make the objectives, technical solutions and advantages of the present disclosure more clear.

It should be noted that all expressions using "first" and "second" and the like in the embodiments of the present disclosure are to distinguish two or more different entities or different parameters of a same name. It can be seen that "first" and "second" and the like are only for the convenience of expression, and should not be understood as limiting embodiments of the present disclosure. This will not be explained one by one any more in subsequent embodiments.

For a phenomenon that a pull-up node PU may be maintained at a high potential for a certain period of time when using an Xon function to solve the power-off after-image problem in a shift register, the present disclosure proposes a power-off discharge approach, wherein it is possible to perform discharge for the pull-up node after a driver performs the Xon function, thereby avoiding a signal coupling error incurred by subsequent power-on, and improving the display effect. That is, with the approach of to the present disclosure, the circuit may return to a stable state after the Xon function is performed upon power-off, and timing error at the moment of power-on is avoided.

Figure 1:
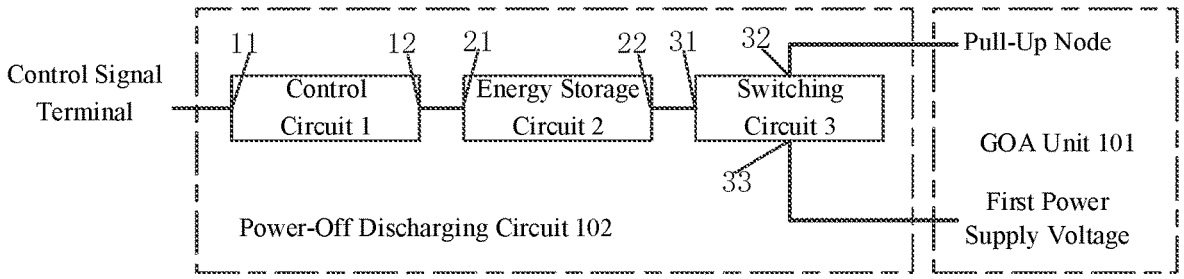
FIG. 1 illustrates a structural block diagram of a power-off discharging circuit according to an embodiment of the present disclosure.

FIG. 1 illustrates a structural block diagram of a power-off discharging circuit according to an embodiment of the present disclosure. The power-off discharging circuit may be used for discharging a gate driver. The gate driver consists of a series of GOA units, allowing separate control of different units. Embodiments of the present disclosure are primarily directed to a problem that a pull-up node in a GOA unit 101 is at a certain high potential when the Xon function ends. Therefore, the power-off discharging circuit 102 is coupled to each GOA unit 101.

The power-off discharging circuit 102 comprises a control circuit, an energy storage circuit, and a switching circuit. An input terminal 11 of the control circuit 1 is coupled to a control signal terminal, and an output terminal 12 of the control circuit 1 is coupled to a first terminal 21 of the energy storage circuit 2. A second terminal 22 of the energy storage circuit 2 is coupled to a first terminal 31 (e.g., a control terminal) of the switching circuit 3. The second terminal 32 of the switching circuit 3 is coupled to the pull-up node of the GOA unit 101, and a third terminal 33 of the switching circuit 3 is coupled to a first power supply voltage terminal.

The control circuit 1 is configured to control the charge and discharge of the energy storage circuit 2 based on a control signal input on the control signal terminal after the Xon function is enabled.

The energy storage circuit 2 is configured to correspondingly control the second terminal 32 and the third terminal 33 of the switching circuit 3 to be conductively-connected or disconnected via its charging or discharging, and in turn control the pull-up node and the first power supply voltage terminal to be conductively-connected or disconnected.

The switching circuit 3 is configured to receive control of the energy storage circuit 2 through the first terminal 31 such that the pull-up node and the first power supply voltage terminal are conductively-connected or disconnected by the charging or discharging of the energy storage circuit. In one embodiment, the charging or discharging of the energy storage circuit 2 will cause the potential on the first terminal 31 to change and thereby control the turn-on or off of the switching circuit 31.

According to the approach of the present disclosure, a self-discharge structure is added to the gate driving circuit. This may allow addressing problems about abnormity of a transient signal and an output of the gate driver upon power-on and power-off of a display, and making the output signal of the gate driving circuit more stable eventually.

It can be seen from the above embodiment that the power-off discharging circuit according to the present disclosure may implement a discharge operation for the pull-up node.

In some embodiments, when the Xon function is enabled, the first power supply voltage terminal for example may be pulled up to a high potential, and the control circuit 1 causes the energy storage circuit to be charged through the first power supply voltage terminal to store electrical energy. When the Xon function ends, the first power supply voltage terminal changes to a low potential, and the energy storage circuit 2 is configured to not turn on the switching circuit 3 via the stored electrical energy until the Xon function ends. At this time, the conductive connection between the pull-up node and the first power supply voltage terminal causes the pull-up node to conductively connect with a low potential signal. That is, the high potential present in the pull-up node will be released. As such, even if the power is turned on again, no interference will be caused to respective control signals after power-on, because the charges in the pull-up node are released, that is, by way of example, a thin-film transistor TFT switch that is correspondingly controlled will be turned off. Therefore, the power-off discharging circuit according to an embodiment of the present disclosure allows discharging the pull-up node after the gate driver performing the Xon function. This avoids signal coupling errors upon next power-on, and improves the display effect eventually.

Figure 2:
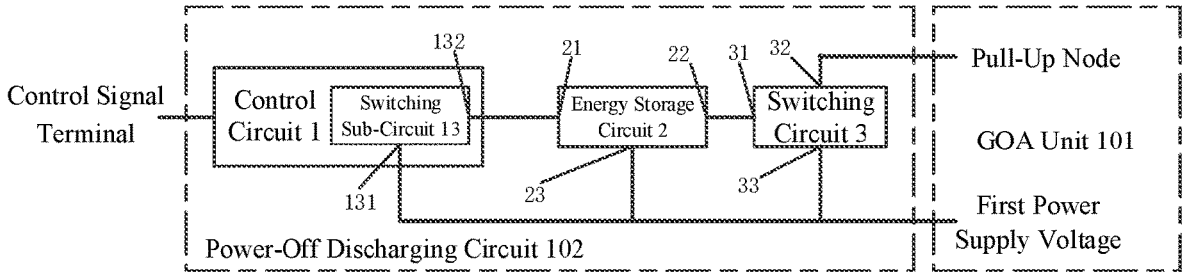
FIG. 2 illustrates a structural block diagram of another power-off discharging circuit according to an embodiment of the present disclosure.

FIG. 2 illustrates a structural block diagram of another power-off discharging circuit according to an embodiment of the present disclosure. As shown in the figure, the control circuit 1 includes a switching sub-circuit 13. A first terminal 131 of the switching sub-circuit 13 and a third terminal 23 of the energy storage circuit 2 are both coupled to the first power supply voltage terminal. A second terminal 132 of the switching sub-circuit 13 is coupled to the first terminal 21 of the energy storage circuit 2. It will be appreciated that in this embodiment, the second terminal 132 is used as the output terminal of the control circuit. The control circuit 1 is further configured to control conductive connection or disconnection of the first terminal and the second terminal of the switching sub-circuit 13 based on the control signal. When the switching sub-circuit 13 is turned on, if the first power supply voltage terminal is at a high potential, the storage circuit 2 is controlled to be charged, and if the first power supply voltage terminal is at a low potential, the energy storage circuit 2 is controlled to be discharged. As such, only when the Xon function is enabled, the switching sub-circuit 13 in the control circuit 1 is turned on, thereby enabling both terminals (i.e., the second terminal and the third terminal) of the energy storage circuit to be coupled to the first power supply voltage terminal. Since the Xon function causes all signal lines and GOA outputs (including the first power supply voltage terminal) to be at a high potential, the energy storage circuit 2 will be charged. When the Xon function ends, the first power supply voltage terminal is pulled down to a low potential, and the second terminal of the energy storage circuit 2 is still at a high potential. This causes a potential difference between the third terminal and the second terminal of the energy storage circuit 2, and in turn makes the switching circuit 3 be turned on.

As known from the above structure, since the first power supply voltage terminal is placed at a high potential only when the Xon function is enabled, and the first power supply voltage terminal is pulled down after the Xon function ends, the charging of the energy storage circuit can be implemented only after the Xon function is enabled. In a normal case, turn-on of the switching sub-circuit 13 will cause both terminals of the energy storage circuit 2 to be coupled to the first power supply voltage terminal which is at a low potential. This will cause the energy storage circuit 2 to be discharged and then will not turn on the switching circuit to affect the normal drive of the GOA unit. Therefore, the power-off discharging circuit according to an embodiment of the present disclosure can discharge the high potential existing in the pull-up node after the Xon function is enabled, without causing adverse impact to other control processes. This ensures the safety and stability of a relevant display driving circuit.

Figure 3:
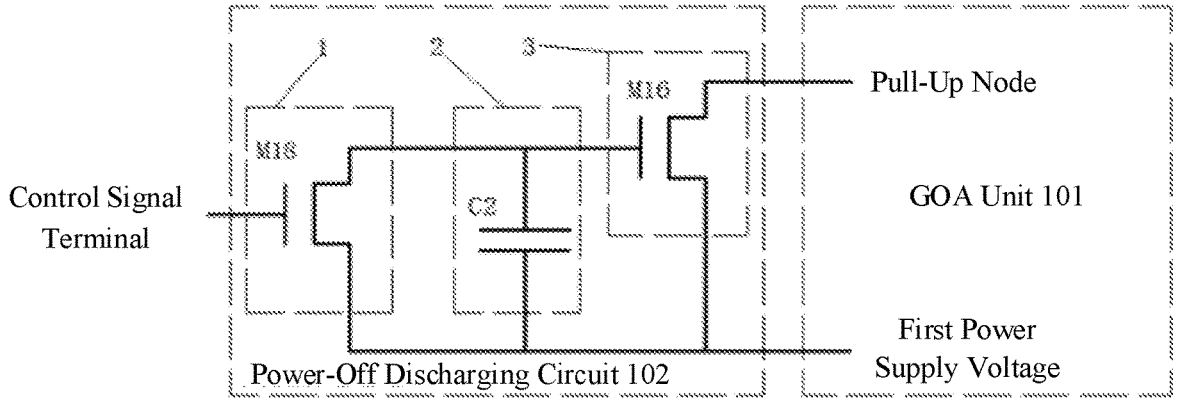
FIG. 3 illustrates a circuit configuration diagram of a power-off discharging circuit according to an embodiment of the present disclosure.

FIG. 3 illustrates a circuit configuration diagram of a power-off discharging circuit according to an embodiment of the present disclosure. As shown in the figure, the switching circuit 3 includes a discharge thin film transistor M16. A first electrode of the discharge thin film transistor M16 is coupled to a pull-up node PU of a GOA unit. A second electrode of the discharge thin film transistor M16 is coupled to a first power supply voltage terminal Vss of the GOA unit. A gate of the discharge thin film transistor M16 is coupled to the second terminal of an energy storage circuit. The first electrode of the discharge thin film transistor M16 may be a source or a drain, and the second electrode of the discharge thin film transistor M16 is a drain or a source corresponding to the first electrode. In some embodiments, the discharge thin film transistor M16 herein may also be replaced with a unit or device having the same switching function, or a same switching process may be implemented using a combination of a plurality of discharge thin film transistors.

The energy storage circuit 2 includes an energy storage capacitor C2. The first terminal of the energy storage capacitor C2 is coupled to the first power supply voltage terminal Vss, and the second terminal of the energy storage capacitor C2 is coupled to the first terminal of the switching circuit 3 and the output terminal of the control circuit.

The control circuit 1 includes a control thin film transistor M18. A first electrode of the control thin film transistor M18 is coupled to the first power supply voltage terminal; a second electrode of the control thin film transistor M18 is coupled to the first terminal of the energy storage circuit; a gate of the control thin film transistor M18 is coupled to a control signal terminal. Optionally, the control signal terminal is a signal line terminal, an output terminal of any GOA unit, or a preset control signal terminal. The first electrode of the control thin film transistor M18 is a source or a drain, and the second electrode of the control thin film transistor M18 is a drain or a source corresponding to the first electrode. The signal line terminal or the output terminal of the GOA unit may refer to a relevant node that will be placed at a high potential when the Xon function is performed. As such, it is possible to ensure that when the Xon function is performed, the control thin film transistor M18 in the control circuit will be turned on, which will in turn enable the energy storage circuit 2 to store energy for charging.

The first power supply voltage terminal Vss is pulled up to a high potential when the Xon function is enabled. As such, when the control thin film transistor is turned on, the first power supply voltage that is at a high potential enables the energy storage circuit to be charged. The first power supply voltage terminal Vss will fall back to a low potential when the Xon function ends. At this point, the energy storage circuit can be discharged when the control thin film transistor is turned on.

Preferably, the energy storage capacitor C2 has a capacitance value of 10 fF~9000 fF.

It should be noted that, all of the transistors used in all embodiments of the present disclosure may be thin film transistors or field effect transistors or other devices having the same characteristics. In various embodiments, the manners for connecting the drain and source of each transistor may be interchanged. Therefore, the drain and source of each transistor in the embodiment of the present disclosure are in fact not different. Herein, only for the purpose of distinguishing the two electrodes of the transistor except the gate, one of the two electrodes is called drain and the other is called source. It may be appreciated that the thin film transistor used in the embodiment of the present disclosure may be an N-type transistor or a P-type transistor. In an embodiment of the present disclosure, when an N-type thin film transistor is employed, its first electrode may be a source and the second electrode may be a drain. In the above embodiments, the description is presented by exemplarily taking an N-type transistor as the thin film transistor, namely the thin film transistor is turned on when the signal of the gate is at a high level. It may be appreciated that when a P-type transistor is used, a same effect can be achieved by adjusting timing of driving signals accordingly.

Figure 4:
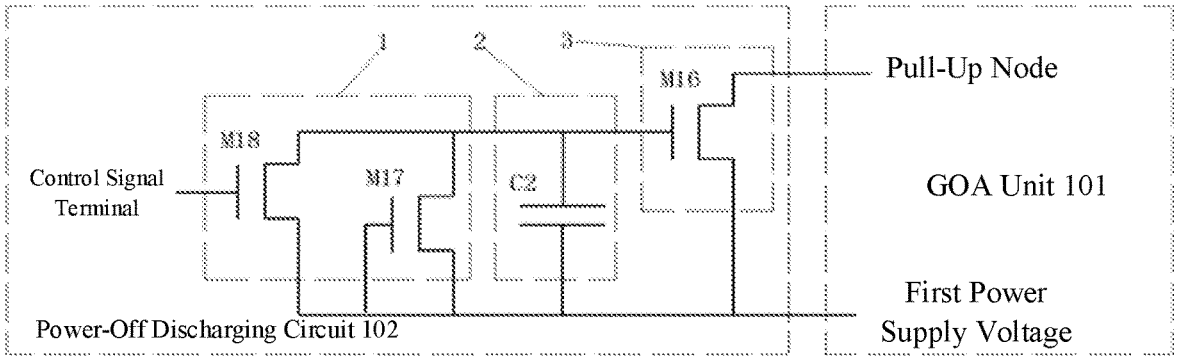
FIG. 4 illustrates a circuit configuration diagram of another power-off discharging circuit according to an embodiment of the present disclosure.

FIG. 4 illustrates a circuit configuration diagram of another power-off discharging circuit according to an embodiment of the present disclosure. As shown in the figure, the control circuit further includes an auxiliary thin film transistor M17. A first electrode of the auxiliary thin film transistor M17 and a gate of the auxiliary thin film transistor M17 are both coupled to the first power supply voltage terminal; a second electrode of the auxiliary thin film transistor M17 is coupled to the second terminal of the energy storage capacitor. The first electrode of the auxiliary thin film transistor is a source or a drain, and the second electrode of the auxiliary thin film transistor is a drain or a source corresponding to the first electrode.

With addition of the auxiliary thin film transistor M17, even if an error occurs in the control thin film transistor M18 or a control signal terminal connected with the gate of the control thin film transistor M18 when the Xon function is enabled, it is still possible to directly turn on the auxiliary thin film transistor M17 via pull-up of the first power supply voltage terminal Vss such that both terminals of the energy storage capacitor C2 are at a high potential to control charging of the energy storage capacitor C2. This in turn ensures that the pull-up node PU can be discharged stably after the Xon function ends. Therefore, the auxiliary thin film transistor M17 can further improve the stability and reliability of the power-off discharging circuit according to an embodiment of the present disclosure.

Figure 5:
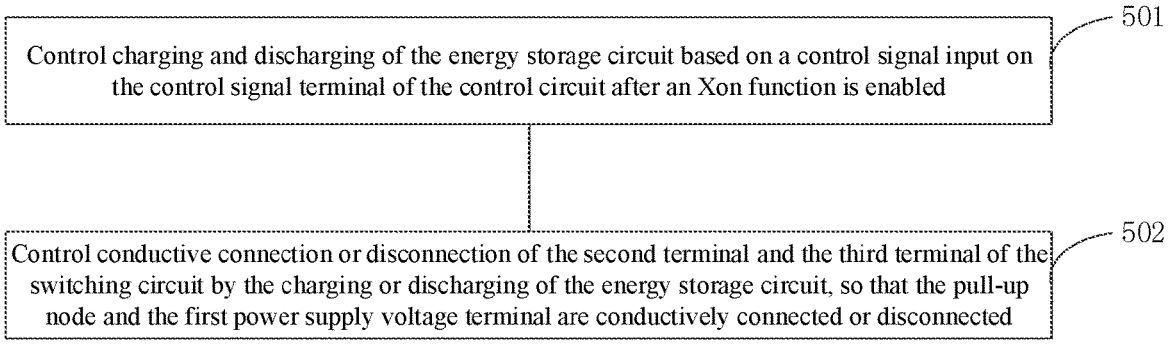
FIG. 5 illustrates a flow chart of a driving method of a power-off discharging circuit according to an embodiment of the present disclosure.

FIG. 5 illustrates a method of discharging using the power-off discharging circuit according to an embodiment of the present disclosure. The method comprises:

At step 501, after the Xon function is enabled, controlling charging or discharging of the energy storage circuit based on a control signal input on a control signal terminal of the control circuit. In some embodiments, when an active control signal is received, the energy storage circuit is controlled to be charged if the first power supply voltage terminal is at a high potential, and the energy storage circuit is controlled to be discharged if the first power supply voltage terminal is at a low potential.

At step 502, controlling conductive connection or disconnection of the second terminal and the third terminal of the switching circuit via the charging or discharging of the energy storage circuit, so that the pull-up node and the first power supply voltage terminal are conductively-connected or disconnected. The energy storage circuit stores electrical energy via charging and thereby changes the potential of the second terminal of the energy storage circuit. In some embodiments, the energy stored by the energy storage circuit, namely, the potential of the second terminal of the energy storage circuit will not cause the switching circuit to be turned on until the Xon function ends, which in turn enables the pull-up node to conductively connect with the first power supply voltage terminal. At this time, the potential of the pull-up node is at the same level as that of the first power supply voltage terminal. Since the first power supply voltage terminal will be pulled down to a low level after the Xon function ends, the potential of the pull-up node will be pulled down, i.e., the pull-up node will release residual charges via signal control of the power-off discharging circuit. In this way, even if the power is turned on again, the signal coupling phenomenon will not occur.

Figure 6:
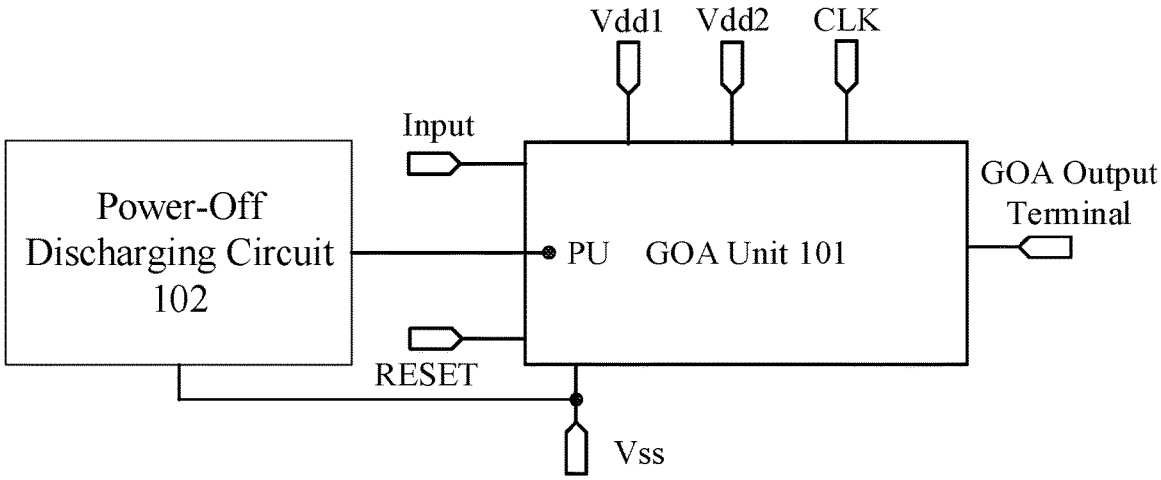
FIG. 6 illustrates a schematic diagram showing a connection relationship of a driving circuit according to an embodiment of the present disclosure.

FIG. 6 shows a schematic diagram of connection configuration of a gate driving circuit according to an embodiment of the present disclosure. The gate driving circuit includes a GOA unit 101 and a power-off discharging circuit 102 as described above. A pull-up node PU is provided in the GOA unit 101. The GOA unit 101 has a signal input terminal Input, a reset signal terminal RESET, a first power supply voltage terminal Vss, a second power supply voltage terminal Vdd1, a third power supply voltage terminal Vdd2, a clock signal terminal CLK, and a GOA output terminal. The GOA unit 101 is configured to output a clock signal at the clock signal terminal to the GOA output terminal when the input signal on the signal input terminal is at an active input level.

The first power supply voltage terminal Vss is a low power supply voltage terminal. The second power supply voltage terminal Vdd1 and the third power supply voltage terminal Vdd2 are high power supply voltage terminals.

The power-off discharging circuit 102 is coupled to the pull-up node PU and the first power supply voltage terminal Vss of the GOA unit 101 respectively.

Figure 7:
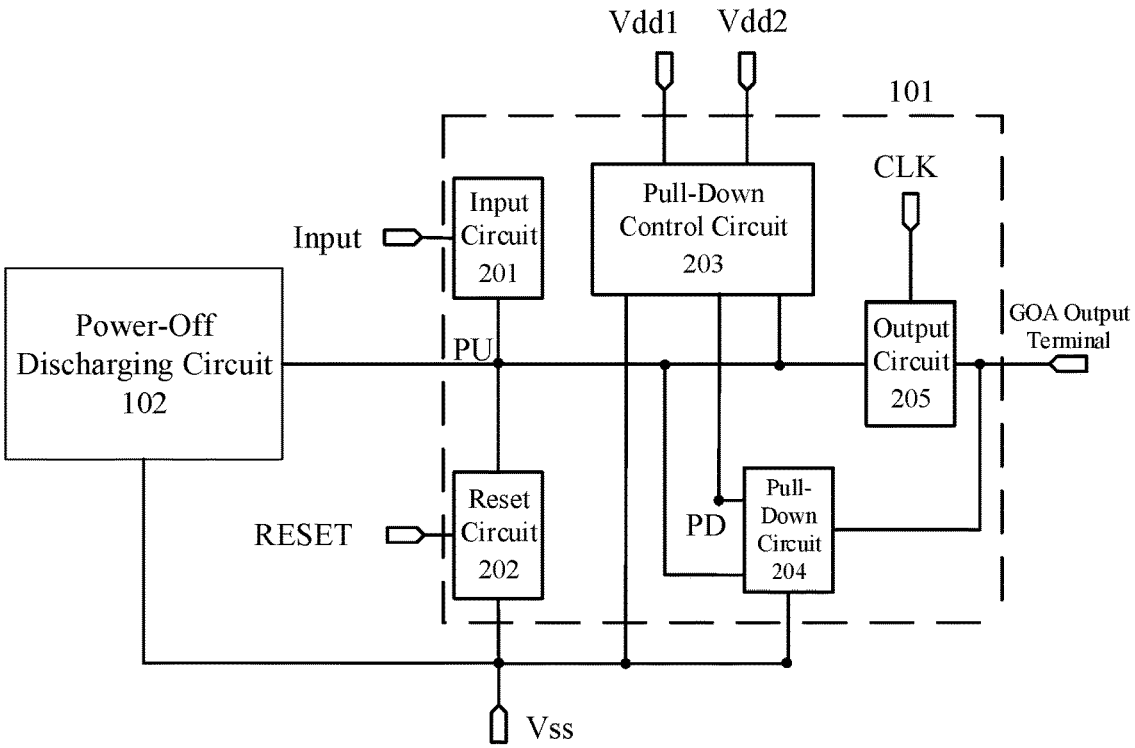
FIG. 7 illustrates a structural block diagram of a GOA unit in a driving circuit according to an embodiment of the present disclosure.

FIG. 7 illustrates a block diagram showing the structure of a GOA unit in a gate driving circuit according to an embodiment of the present disclosure.

As shown in FIG. 7, in one embodiment, the GOA unit 101 comprises: an input circuit 201, a reset circuit 202, a pull-down control circuit 203, a pull-down circuit 204 and an output circuit 205.

The input circuit 201 is coupled to a signal input terminal Input and a pull-up node PU, and is configured to transfer a received input signal to the pull-up node PU when the input signal on the signal input terminal Input is at an active input level.

The reset circuit 202 is coupled to a reset signal terminal RESET, the first power supply voltage terminal Vss and the pull-up node PU, and is configured to pull down a pull-up signal at the pull-up node PU to the power supply voltage at the first power supply voltage terminal Vss when the reset signal of the reset signal terminal RESET is at the active control level.

The pull-down control circuit 203 is coupled to the second power supply voltage terminal Vdd1, the third power supply voltage terminal Vdd2, the pull-up node PU, a pull-down node PD and the first power supply voltage terminal Vss, and is configured to control whether the pull-down circuit 204 operates. For example, the pull-down control circuit 203 generates at the pull-down node PD a pull-down signal at an inactive pull-down level when the pull-up signal at the pull-up node PU is at the active pull-up level; and in response to the high-level voltage signal Vdd1 or Vdd2, supplies the high-level voltage signal Vdd1 or Vdd2 to the pull-down node PD, when the pull-up signal at the pull-up node PU is at the inactive pull-up level.

The pull-down circuit 204 is coupled to the pull-down node PD, the pull-up node PU, the first power supply voltage terminal Vss and a GOA output terminal, and is configured to pull down the GOA output terminal and the pull-up node PU to the power supply voltage of the first power supply voltage terminal Vss when the pull-down signal at the pull-down node PD is at an active pull-down level.

The output circuit 205 is coupled to the clock signal terminal CLK, the pull-up node PU and the GOA output terminal, and is configured to output the clock signal of the clock signal terminal CLK to the GOA output terminal when the pull-up signal at the pull-up node PU is at the active pull-up level.

The power-off discharging circuit 102 is coupled to the pull-up node PU and the first power supply voltage terminal Vss, and is configured to release the residual charges in the pull-up node PU after the Xon function is enabled for gate driving, thereby avoiding adverse impacts like signal coupling etc., exerted by the residual charges on subsequent power-on operation.

Figure 8:
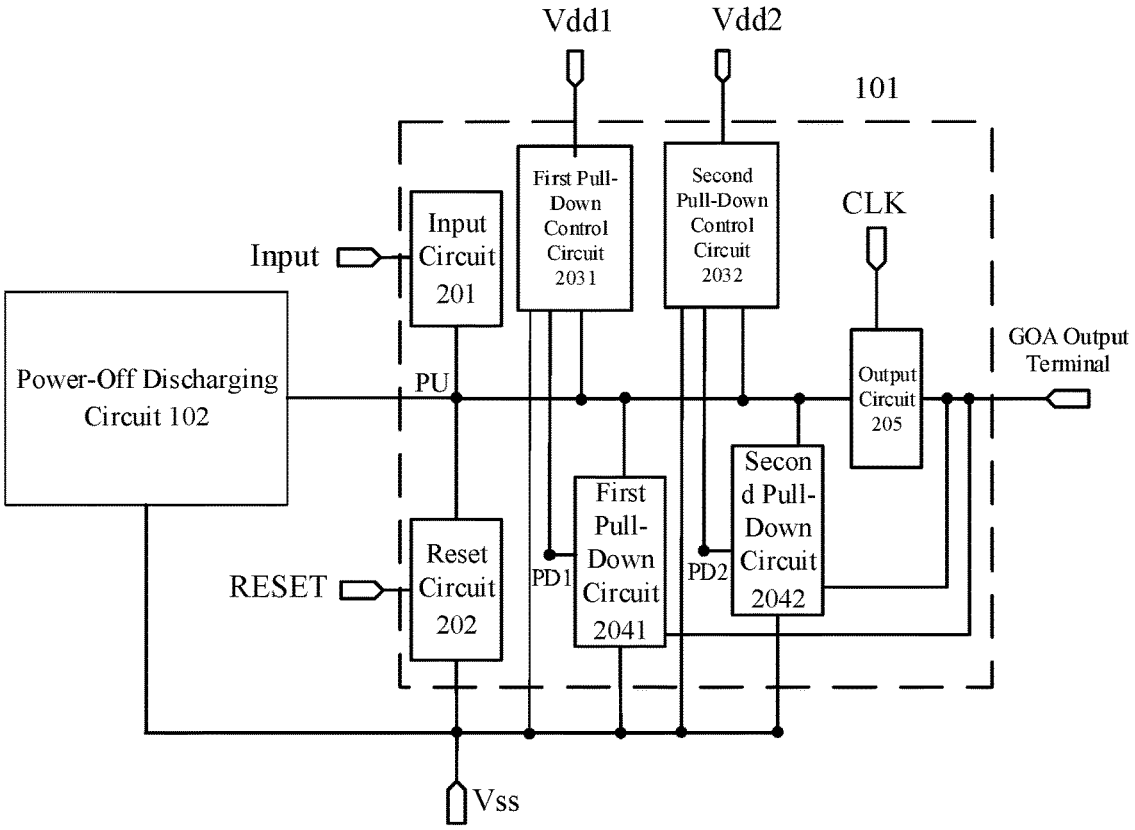
FIG. 8 illustrates a structural block diagram a GOA unit in another driving circuit according to an embodiment of the present disclosure.

FIG. 8 illustrates a block diagram showing the structure of a GOA unit in another gate driving circuit according to an embodiment of the present disclosure.

As shown in FIG. 8, the pull-down control circuit 203 includes a first pull-down control circuit 2031 and a second pull-down control circuit 2032, and the pull-down node PD includes a first pull-down node PD1 and a second pull-down node PD2.

The pull-down circuit 204 includes a first pull-down circuit 2041 and a second pull-down circuit 2042.

The first pull-down control circuit 2031 is coupled to the second power supply voltage terminal Vdd1, the pull-up node PU, the first pull-down node PD1, and the first power supply voltage terminal Vss, and is configured to control whether the first pull-down circuit 2041 operates. For example, the first pull-down control circuit 2031 generates at the first pull-down node PD1 a pull-down signal at an inactive pull-down level when the pull-up signal at the pull-up node PU is at the active pull-up level; and in response to the high-level voltage signal Vdd1, supplies the high-level voltage signal Vdd1 to the first pull-down node PD1, when the pull-up signal at the pull-up node PU is at an inactive pull-up level.

The second pull-down control circuit 2032 is coupled to the third power supply voltage terminal Vdd2, the pull-up node PU, the second pull-down node PD2 and the first power supply voltage terminal Vss, and is configured to control whether the second pull-down circuit 2042 operates. For example, the second pull-down control circuit 2032 generates at the second pull-down node PD2 a pull-down signal at an inactive pull-down level when the pull-up signal at the pull-up node PU is at the active pull-up level; and in response to the high-level voltage signal Vdd2, supplies the high-level voltage signal Vdd2 to the second pull-down node PD2, when the pull-up signal at the pull-up node PU is at an inactive pull-up level.

The first pull-down circuit 2041 is coupled to the first pull-down node PD1, the pull-up node PU, the first power supply voltage terminal Vss and the GOA output terminal, and is configured to pull down the GOA output terminal and the pull-up node PU to the power supply voltage of the first power supply voltage Vss when the pull-down signal at the first pull-down node PD1 is at an active pull-down level.

The second pull-down circuit 2042 is coupled to the second pull-down node PD2, the pull-up node PU, the first power supply voltage terminal Vss and the GOA output terminal, and is configured to pull down the GOA output terminal and the pull-up node PU to the power supply voltage of the first power supply voltage Vss when the pull-down signal at the second pull-down node PD2 is at an active pull-down level.

Figure 9:
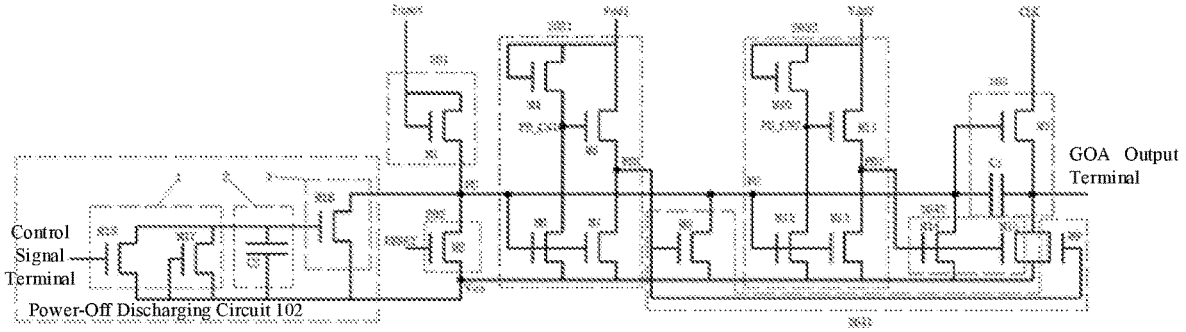
FIG. 9 illustrates a schematic diagram showing a circuit structure of a driving circuit according to an embodiment of the present disclosure.

FIG. 9 illustrates a circuit configuration diagram of a gate driving circuit in accordance with an embodiment of the present disclosure. In FIG. 9, by way of example, all transistors are shown as N-type transistors, which are turned on when a gate is input with a high level.

As shown in FIG. 9, in an embodiment, input circuit 201 includes an input transistor M1. A gate and a first electrode of the input transistor M1 are coupled to the signal input terminal Input respectively, and a second electrode of the input transistor M1 is coupled to the pull-up node PU. When the input signal of the signal input terminal Input is at a high level, the input transistor M1 is turned on, and the input signal of the signal input terminal Input is transferred to the pull-up node PU. It may be appreciated that the specific implementation structure and control manner of the above input circuit are merely exemplary, and embodiments of the present disclosure are not limited thereto. Instead, the input circuit 201 may also employ other suitable structures and control manners.

In one embodiment, the reset circuit 202 includes a reset transistor M2. A gate of the reset transistor M2 is coupled to the reset signal terminal RESET, a first electrode thereof is coupled to the pull-up node PU, and a second electrode thereof is coupled to the first power supply voltage terminal Vss. When the reset signal at the reset signal terminal RESET is at a high level, the reset transistor M2 is turned on, pulling down the pull-up signal at the pull-up node PU to the power supply voltage of the first power supply voltage terminal Vss. It may be appreciated that the reset circuit 202 described above is merely an example and may have other structures.

In one embodiment, the pull-down control circuit includes a first pull-down control circuit 2031 and a second pull-down control circuit 2032. The pull-down node includes a first pull-down node PD1 and a second pull-down node PD2.

The first pull-down control circuit 2031 includes a first pull-down control transistor M5, a second pull-down control transistor M7, a third pull-down control transistor M4 and a fourth pull-down control transistor M6. A gate of the first pull-down control transistor M5 is coupled to a first pull-down control node PD_CN1, a first electrode thereof is coupled to the second power supply voltage terminal Vdd1, and a second electrode thereof is coupled to the first pull-down node PD1. A gate of the second pull-down control transistor M7 is coupled to the pull-up node PU, a first electrode thereof is coupled to the first pull-down node PD1, and a second electrode thereof is coupled to the first power supply voltage terminal Vss. A gate and a first electrode of the third pull-down control transistor M4 are coupled to the second power supply voltage terminal Vdd1 respectively, and a second electrode thereof is coupled to the first pull-down control node PD_CN1. A gate of the fourth pull-down control transistor M6 is coupled to the pull-up node PU, a first electrode thereof is coupled to the first pull-down control node PD_CN1, and a second electrode thereof is coupled to the first power supply voltage terminal Vss.

The second pull-down control circuit 2032 includes a fifth pull-down control transistor M11, a sixth pull-down control transistor M13, a seventh pull-down control transistor M10, and an eighth pull-down control transistor M12. A gate of the fifth pull-down control transistor M11 is coupled to a second pull-down control node PD_CN2, a first electrode thereof is coupled to the third power supply voltage terminal Vdd2, and a second electrode thereof is coupled to the second pull-down node PD2. A gate of the sixth pull-down control transistor M13 is coupled to the pull-up node PU, a first electrode thereof is coupled to the second pull-down node PD2, and a second electrode thereof is coupled to the first power supply voltage terminal Vss. A gate and a first electrode of the seventh pull-down control transistor M10 are coupled to the third power supply voltage terminal Vdd2 respectively, and a second electrode thereof is coupled to the second pull-down control node PD_CN2. A gate of the eighth pull-down control transistor M12 is coupled to the pull-up node PU, a first electrode thereof is coupled to the second pull-down control node PD_CN2, and a second electrode thereof is coupled to the first power supply voltage terminal Vss.

In one embodiment, the pull-down circuit includes a first pull-down circuit 2041 and a second pull-down circuit 2042.

The first pull-down circuit 2041 includes a first node pull-down transistor M8 and a first output pull-down transistor M9. A gate of the first node pull-down transistor M8 and a gate of the first output pull-down transistor M9 are coupled to the first pull-down node PD1. A second electrode of the first node pull-down transistor M8 and a second electrode of the first output pull-down transistor M9 are coupled to the first power supply voltage terminal Vss. The first electrode of the first node pull-down transistor M8 is coupled to the pull-up node PU. A first electrode of the first output pull-down transistor M9 is coupled to the GOA output terminal. When the pull-down signal at the first pull-down node PD1 is at a high level, the first node pull-down transistor M8 and the first output pull-down transistor M9 are turned on, pulling down the pull-up node PU and the GOA output terminal to the first power supply voltage terminal Vss respectively.

The second pull-down circuit 2042 includes a second node pull-down transistor M14 and a second output pull-down transistor M15. A gate of the second node pull-down transistor M14 and a gate of the second output pull-down transistor M15 are coupled to the second pull-down node PD2. A second electrode of the second node pull-down transistor M14 and a second electrode of the second output pull-down transistor M15 are coupled to the first power supply voltage terminal Vss. A first electrode of the second node pull-down transistor M14 is coupled to the pull-up node PU. A first electrode of the second output pull-down transistor M15 is coupled to the GOA output terminal. When the pull-down signal at the second pull-down node PD2 is at a high level, the second node pull-down transistor M14 and the second output pull-down transistor M15 are turned on, pulling down the pull-up node PU and the GOA output terminal to the power supply voltage of the first power supply voltage terminal Vss respectively.

It may be appreciated that the pull-down control circuit 203 and the pull-down circuit 204 described above are merely examples, and may have other structures.

In one embodiment, the output circuit 205 includes an output transistor M3 and a first capacitor C1. A gate of the output transistor M3 is coupled to the pull-up node PU, a first electrode of the output transistor M3 is coupled to the clock signal terminal CLK, and a second electrode of the output transistor M3 is coupled to the GOA output terminal. A first terminal of the first capacitor C1 is coupled to the pull-up node PU, and a second terminal of the first capacitor C1 is coupled to the GOA output terminal. When the pull-up signal at the pull-up node PU is at a high level, the output transistor M3 is turned on, and the clock signal of the clock signal terminal CLK is output to the GOA output terminal.

It may be appreciated that the output circuit 205 described above is merely an example and may have other structures.

In one embodiment, the power-off discharging circuit includes a control thin film transistor M18, an auxiliary thin film transistor M17, an energy storage capacitor C2 and a discharge thin film transistor M16. A gate of the control thin film transistor M18 is coupled to the control signal terminal. A first electrode of the control thin film transistor M18, a first electrode of the auxiliary thin film transistor M17 and a second terminal of the energy storage capacitor C2 are all coupled to the gate of the discharge thin film transistor M16. A second electrode of the control thin film transistor M18 is coupled to the first power supply voltage terminal Vss. The gate and a second electrode of the auxiliary thin film transistor M17, the first terminal of the energy storage capacitor C2 and a second electrode of the discharge thin film transistor M16 are all coupled to the first power supply voltage terminal Vss. A first electrode of the discharge thin film transistor M16 is coupled to the pull-up node PU.

When the Xon function is enabled, all of signal line terminals are pulled up. When an active level inputted on the control signal terminal enables the control thin film transistor M18 to be turned on, and when the auxiliary thin film transistor M17 is turned on due to pull-up of the first power supply voltage terminal, both terminals of the energy storage capacitor C2 are coupled to the first power supply voltage terminal Vss. At this time, since the first power supply voltage terminal Vss is at a high potential, the energy storage capacitor C2 can be charged. When the Xon function ends, the first power supply voltage terminal Vss is pulled down. However, at this time, the second terminal of the energy storage capacitor C2 is pulled up to a high potential via charging, that is, it is possible to turn on the discharge thin film transistor M16, which in turn enables the pull-up node PU to conductively connect with the first power supply voltage terminal Vss. At this time, the potential of the pull-up node PU is pulled down to a low level same as the first power supply voltage terminal Vss.

It may be appreciated that the discharging circuit 102 described above is merely an example, and may have other structures capable of achieving the same function.

Figure 10:
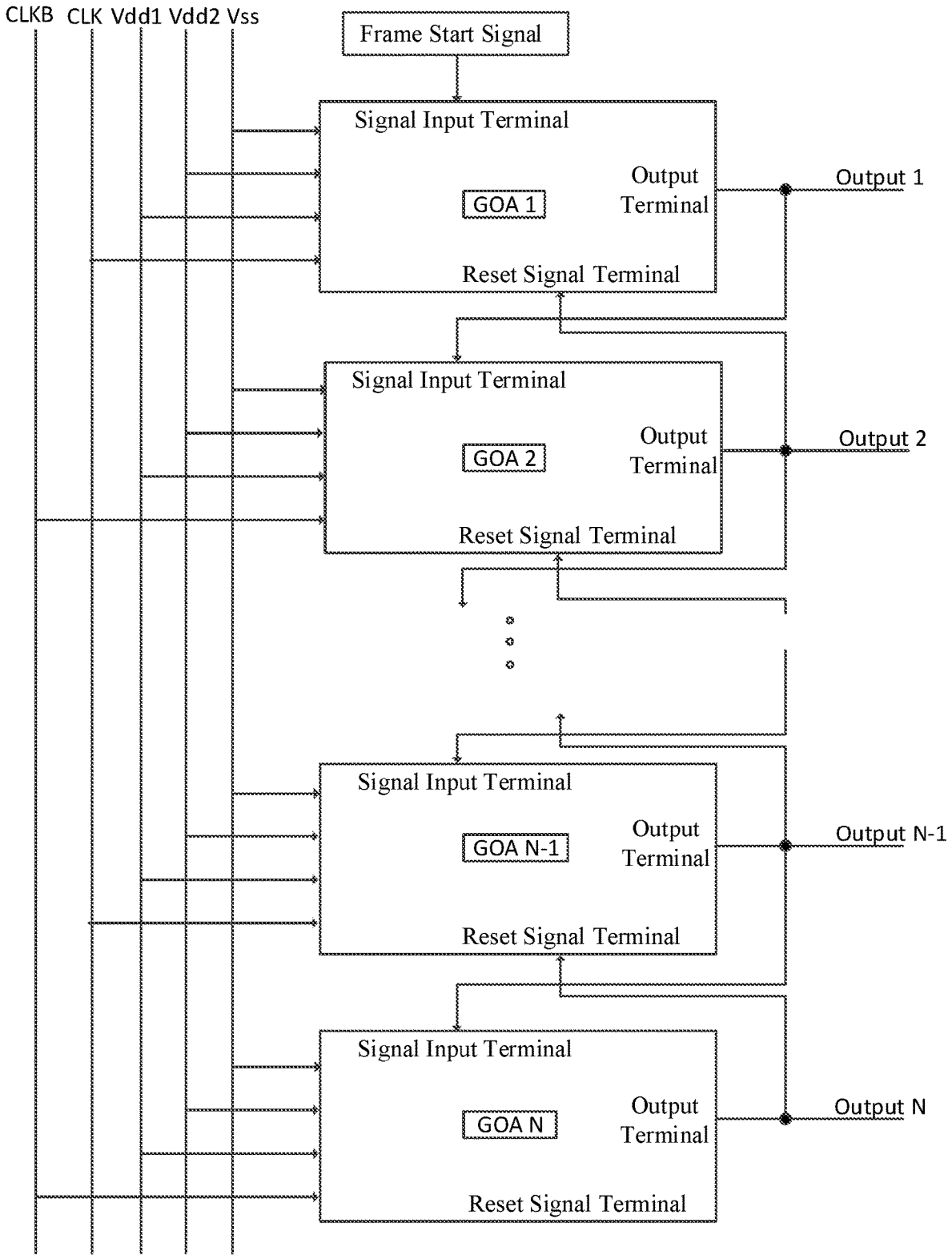
FIG. 10 illustrates a structural schematic diagram of a cascaded GOA driving circuit according to an embodiment of the present disclosure.

FIG. 10 illustrates a structural schematic diagram of a cascaded GOA driving circuit in accordance with an embodiment of the present disclosure.

The GOA driving circuit shown in FIG. 10 includes cascaded N GOA units. The N GOA units are the first GOA unit to the $N^{th}$ GOA unit GOA 1, GOA 2 . . . GOA N−1, and GOA N, wherein N is an integer greater than or equal to 2. Each stage of GOA units may employ the structure described above.

In the cascaded N GOA units, a signal input terminal of the first GOA unit is coupled to a frame start signal, and the reset signal terminal of the $N^{th}$ GOA unit is coupled to the frame start signal. The signal input terminal of each of the second GOA unit to the $N^{th}$ GOA unit is coupled to an output terminal of an upper-stage GOA unit adjacent thereto. The reset signal terminal of each of the first GOA unit to the N−1" GOA unit is coupled to an output terminal of a next-stage GOA unit adjacent thereto. In the GOA driving circuit, the frame start signal is introduced into each stage of GOA units.

The driving signal output terminals of each stage of GOA units are coupled to corresponding gate lines in a display panel for sequentially outputting scanning signals to the corresponding gate lines.

In some other optional embodiments of the present disclosure, a display device is also provided. The display device includes the gate driving circuit described in the above embodiment, and it includes a power-off discharging circuit according to the embodiments of the present disclosure. The display device for example may be: a mobile phone, a tablet computer, a touch notebook, or any other device having a display function.

Figure 11:
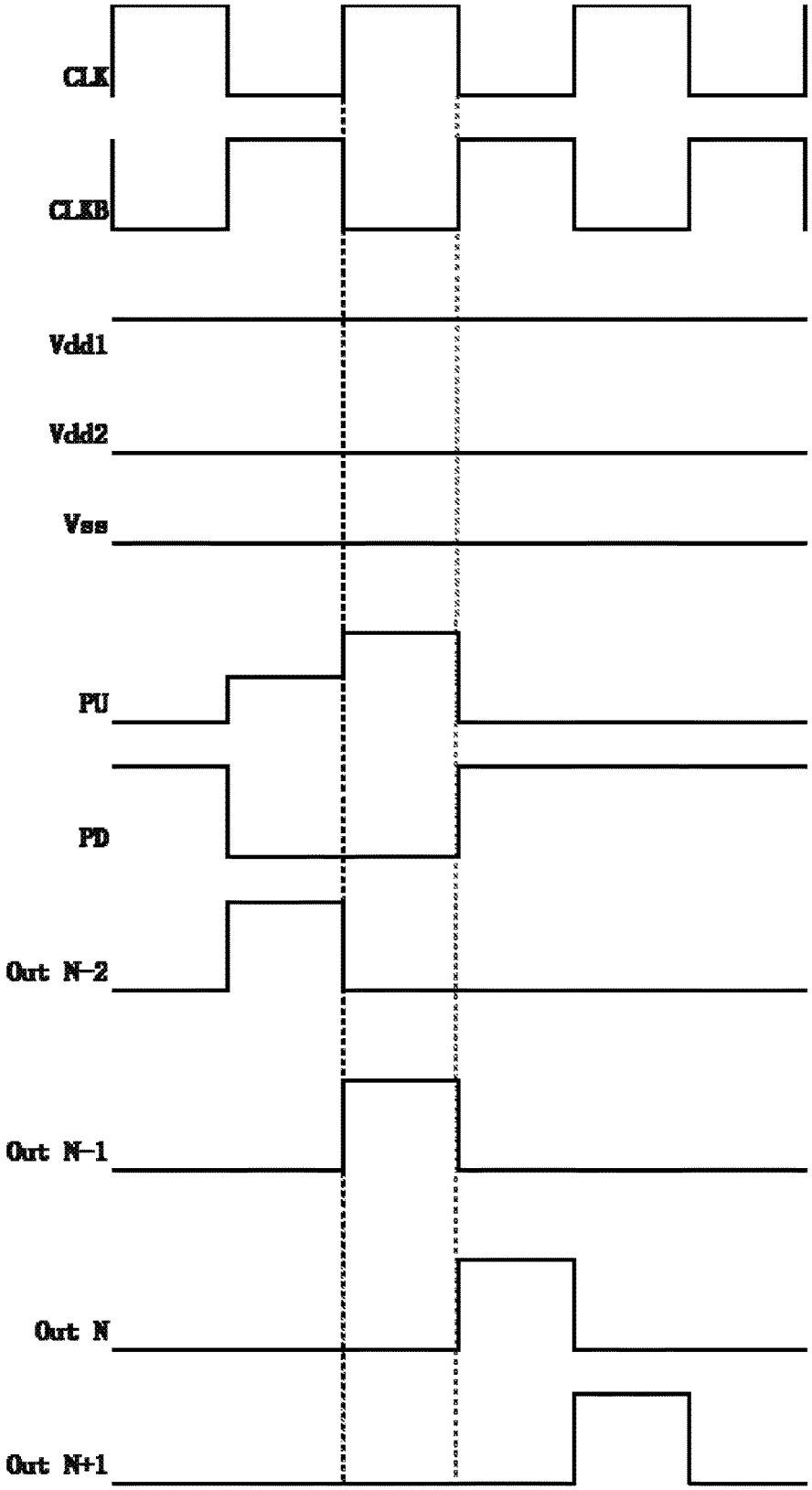
FIG. 11 illustrates a circuit timing diagram of a driving circuit upon normal driving according to an embodiment of the present disclosure.

FIG. 11 illustrates a circuit timing diagram of a gate driving circuit upon normal driving according to an embodiment of the present disclosure.

With a cascade configuration of GOA units, the cascaded GOA units may output active potentials, and these active potentials (such as Out N−2, Out N−1, Out N, Out N+1 shown in FIG. 11) appear in a time sequence based on a clock cycle of the clock signal CLK. As can be seen from FIG. 11, Vss maintains at a low potential during normal driving of the gate driving circuit.

Figure 12:
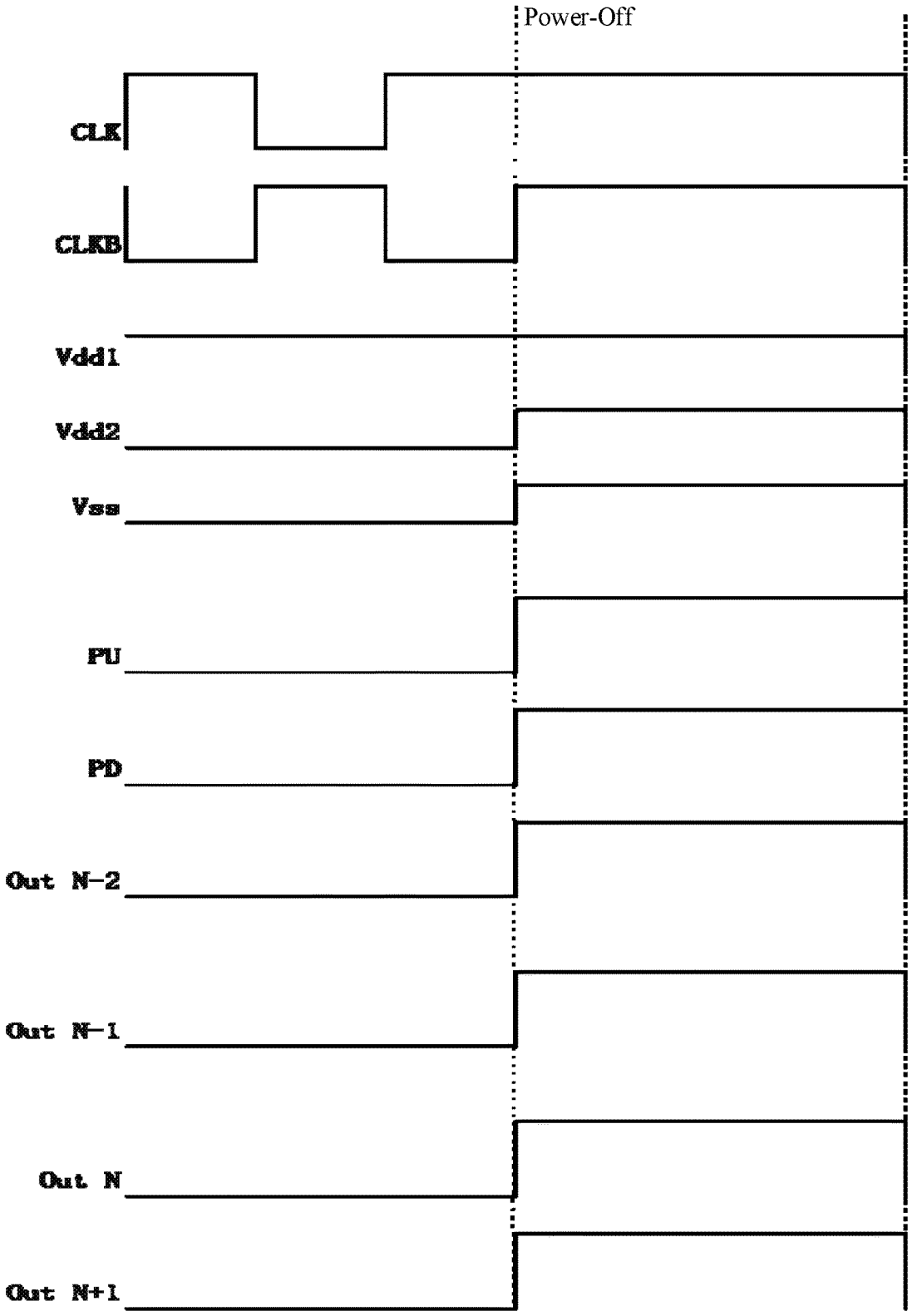
FIG. 12 illustrates a circuit timing diagram of a driving circuit upon powering-down according to an embodiment of the present disclosure.

Since the approach of the present disclosure mainly relates to a problem of timing signal control upon power-on/off or sudden power-down, the embodiment of the present disclosure also focuses on the state of the circuit after power-off. FIG. 12 illustrates a circuit timing diagram upon power-down of a gate driving circuit in accordance with an embodiment of the present disclosure. When the gate driving circuit performs the Xon function, that is, at the moment of power-down, all signals in the circuit are pulled up within a short period of time. As shown in FIG. 12, after power-off, clock signals (such as CLK and CLKB), power supply voltage signals (such as Vdd1, Vdd2, Vss), pull-up and pull-down signals (PU and PD) and output signals of GOA units (for example Out N−2, Out N−1, Out N, Out N+1) and the like are pulled up to a high potential, forming a state in which all of the gate drivers are at high together.

Referring back to FIG. 9, the pull-up node PU is coupled to the first capacitor C1. The PU node is at a high voltage after power-off. After the Xon function ends, almost all of the transistors are in an turned-off state, except for transistors controlled by the PU node (e.g., M6, M7, M12, M13, etc.). This is because, due to the charging of the capacitor C1, the voltage of the pull-up node PU still remains high for a short period of time after power-down. As such, after the display panel is switched on again and after the signal is input again, the un-reset PU node is probably coupled by the CLK signal, resulting in an erroneous gate output.

This problem is solved by the approach of the present disclosure. By adding a structure for discharging the first capacitor C1 and by using the energy storage capacitor C2 to maintain charges for a certain period of time, it is possible to make charges of the PU node vary with the voltage of the signal line, for example, keep consistent with the first power supply voltage terminal Vss, that is, change from a high potential to a low potential. This reduces the probability of occurrence of an output error upon power-on/off eventually.

Referring to FIG. 9, enablement of the Xon function will generally make all of signal lines and GOA outputs be at a high potential during power-down of a driving circuit corresponding to GOA units. Subsequently, the potential on the signal lines gradually returns to zero. However, the PU node will remain at a high potential for a period of time under the effect of C1. By adding a power-off discharging circuit 102 according to an embodiment of the present disclosure, M17 is turned on and/or M18 is turned on when the Xon function is enabled. This will cause both terminals of the energy storage capacitor C2 to be set high. When Vss gradually falls, the other terminal of C2 may remain at a high potential state for a short period of time. Therefore, the energy storage capacitor C2 may turn on M16, thereby conductively connecting the PU node with the already-zeroed Vss. This pulls the potential of the pull-up node PU down to a low potential. Therefore, after power-down, C2 may maintain power supply for a period of time to lower the voltage of the PU node, thereby avoiding a timing signal error upon next power-on.

In addition, in a normal driving process, taking the $N^{th}$ GOA unit as an example, M18 will be turned on when the output terminal (output N−2) of the $N-2^{th}$ GOA unit outputs an active level, which in turn discharges the C2, and pulls down the voltage at the gate of M16 so that M16 is turned off. Therefore, the power-off discharging circuit of the present disclosure will not have any adverse effect on the normal driving of respective circuit(s) in the shift register.

It should be noted that, although only a clock signal CLK signal is shown in FIGS. 6-9, a CLK signal and a CLKB signal having opposite potentials may be simultaneously used in the actual process. The CLKB signal shown in FIGS. 10-12 refers to a timing control signal that is opposite to the potential of the CLK signal.

In addition, although the structure described in FIG. 10 does not show the power-off discharging circuit, it will be appreciated that each GOA unit in the cascade structure may be coupled to the power-off discharging circuit. In addition, the cascaded GOA units may be coupled to a common power-off discharging circuit, or the power-off discharging circuit may be provided individually for each GOA unit.

In an embodiment, if the control signal terminal in the power-off discharging circuit is a preset control signal or the first power supply voltage, all GOA units may be coupled to one power-off discharging circuit. This has an advantage of greatly saving space and related processes.

In an embodiment, an individual power-off discharging circuit may also be provided for each GOA unit. At this time, optionally, the control signal terminal in the power-off discharging circuit may be coupled to the output terminal of the preceding GOA unit in the cascade structure. This will make the control accurate and easy to adjust, especially when there is a problem with a certain GOA unit. This embodiment will be discussed below with reference to FIG. 9 and FIG. 10.

FIG. 10 illustrates a cascade structure of GOA units according to an embodiment of the present disclosure. As shown in the figure, the gate driving based on the GOA unit is implemented by cascading, wherein a signal input terminal Input of the current $N^{th}$ GOA unit may be coupled to an output terminal Output N−1 of a previous GOA unit (namely, $N-1^{th}$ GOA unit). When a power-off discharging circuit is provided for a certain GOA unit in the cascade structure, a control signal terminal of the power-off discharging circuit may be coupled to the output terminal of a GOA unit preceding that GOA unit in the cascade structure. For example, assuming that the $N^{th}$ GOA unit is shown in FIG. 9, the gate of the control thin film transistor M18 may be coupled to the output terminal Output N−X of the $N-X^{th}$ GOA unit. That is, the control signal terminal may be an output terminal of some GOA unit preceding that GOA unit in the cascade structure. As such, it is possible that when the $N-X^{th}$ GOA unit outputs a high potential, the $N^{th}$ GOA unit turns on the control thin film transistor M18 so that both terminals of the energy storage capacitor C2 are coupled to the first power supply voltage terminal Vss. That is, it is possible to discharge the energy storage capacitor C2 in advance so as to prevent charges in the energy storage capacitor C2 from turning on the switching circuit and then causing interference to the control signal of the current GOA unit. Therefore, it is possible to reduce the influence of the power-off discharging circuit on a respective driving circuit via discharging the energy storage capacitor C2 in advance.

Optionally, the gate of the control thin film transistor M18 is coupled to OUTPUT N−2 or OUTPUT N−1. That is, discharging the energy storage capacitor C2 in the current shift register before a work cycle of the $N^{th}$ GOA unit may ensure that the influence of the energy storage capacitor C2 on a respective driving circuit is minimized.

Figure 13:
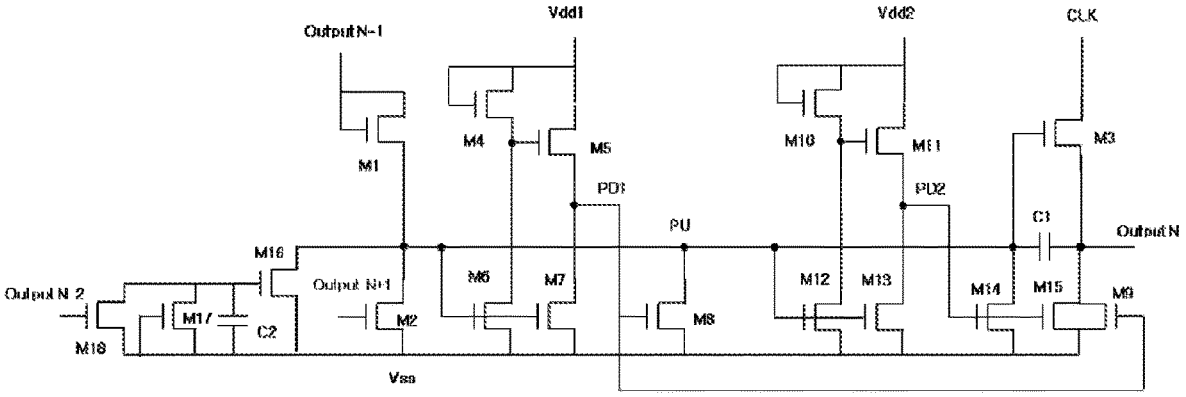
FIG. 13 illustrates a schematic diagram showing a circuit structure of another driving circuit according to an embodiment of the present disclosure.

FIG. 13 illustrates a circuit diagram showing another gate driving circuit according to an embodiment of the present disclosure. As shown in FIG. 13, the current GOA unit is the $N^{th}$ GOA unit, and its signal input terminal Input receives a signal from the output terminal Output N−1 of the $N-1^{th}$ GOA unit, its reset signal terminal receives a signal from the output terminal Output N+1 of the $N+1^{th}$ GOA unit, and its signal output terminal is Output N. Correspondingly, the control signal terminal in the power-off discharging circuit coupled to that GOA unit is coupled to the output terminal Output N−2 of the $N-2^{th}$ GOA unit. As such, when the $N-2^{th}$ GOA unit outputs a high potential, the energy storage capacitor C2 may be discharged in advance. According to the approach of the present disclosure, the accuracy and reliability of discharging the pull-up node PU in the current GOA unit by the power-off discharging circuit is improved.

It should be appreciated by those skilled in the art that the discussion of any of the above embodiments is only exemplary, and is not intended to suggest that the scope of the disclosure (including the claims) is limited to these examples. Under the concept of the present disclosure, the above embodiments or technical features in different embodiments may also be reasonably combined, and steps therein may be implemented in any suitable order. In addition, there exist many other variations of the various aspects of the present disclosure as described above, and the variations are not provided in detail for brevity.

In addition, in order to simplify illustration and discussion and make the present disclosure more apparent, well-known power supply/grounded connections with the integrated circuit (IC) chip and other components may be or may not be shown in the provided drawings. In addition, the apparatus may be shown in the form of a block diagram in order to facilitate the understanding of the present disclosure. This also takes into account the fact that the details of the implementation of these block diagrams are highly dependent on the platform on which the present disclosure is to be implemented (i.e., these details should be completely within the scope of the understanding of those skilled in the art). In the case where the specific details (e.g., circuits) are described to describe the exemplary embodiments of the present disclosure, it will be apparent to those skilled in the art that the present disclosure may be implemented without these specific details or in the case that these specific details change. Therefore, these depictions should be considered as illustrative rather than restrictive.

Although the present disclosure has been described in connection with the specific embodiments of the present disclosure, many substitutions, modifications and variations of these embodiments will be apparent to those skilled in the art according to the foregoing depictions. For example, other memory architectures (e.g., dynamic RAM (DRAM)) may use the embodiments discussed.

Embodiments of the present disclosure are intended to cover all such substitutions, modifications and variations which fall within the scope of the appended claims. Therefore, any omissions, modifications, equivalent substitutions, improvements and so on which are made within the spirit and principle of the present disclosure should be included within the protection scope of the present disclosure.

The invention claimed is:

1. A power-off discharging circuit, comprising:

a control circuit;

an energy storage circuit; and a switching circuit, wherein an input terminal of the control circuit is coupled to a control signal terminal, an output terminal of the control circuit is coupled to a first terminal of the energy storage circuit, a second terminal of the energy storage circuit is coupled to a first terminal of the switching circuit, a second terminal of the switching circuit is coupled to a pull-up node of a gate driving circuit, and a third terminal of the switching circuit is coupled to a first power supply voltage terminal of the gate driving circuit, wherein the control circuit is configured to control charging and discharging of the energy storage circuit based on a control signal input on the control signal terminal when an Xon function is enabled, wherein the Xon function is performed upon power-off to pull up the pull-up node and the first power supply voltage terminal to a high potential, wherein the energy storage circuit is configured to control the second terminal and the third terminal of the switching circuit to be conductively-connected or disconnected respectively via the charging or the discharging, wherein the switching circuit is configured to receive control of the energy storage circuit through the first terminal such that the pull-up node and the first power supply voltage terminal are conductively-connected or disconnected via the charging or the discharging of the energy storage circuit, wherein the first power supply voltage terminal changes to a low potential after the Xon function ends, and wherein the energy storage circuit is configured to not conductively-connect the second terminal and the third terminal of the switching circuit via stored electrical energy until the Xon function ends.

2. The power-off discharging circuit according to claim 1, wherein the control circuit comprises:

a switching sub-circuit, wherein a first terminal of the switching sub-circuit and a third terminal of the energy storage circuit are both coupled to the first power supply voltage terminal, and a second terminal of the switching sub-circuit is coupled to the first terminal of the energy storage circuit, wherein the control circuit is further configured to control conductive connection or disconnection of the first terminal and the second terminal of the switching sub-circuit based on the control signal, and wherein when the switching sub-circuit is turned on, the control circuit is further configured to control the energy storage circuit to charge when the first power supply voltage terminal is at a high potential, and control the energy storage circuit to discharge when the first power supply voltage terminal is at a low potential.

3. The power-off discharging circuit according to claim 1, wherein the control signal terminal is coupled to one of a signal line terminal in the gate driving circuit, an output terminal of a gate on array (GOA) unit, or a preset control signal terminal.

4. The power-off discharging circuit according to claim 1, wherein the switching circuit comprises a discharge thin film transistor, wherein a first electrode of the discharge thin film transistor is coupled to the pull-up node, a second electrode of the discharge thin film transistor is coupled to the first power supply voltage terminal, and a gate of the discharge thin film transistor is coupled to the second terminal of the energy storage circuit, and wherein the first electrode of the discharge thin film transistor comprises a first source or a first drain, and the second electrode of the discharge thin film transistor comprises a second drain or a second source corresponding to the first electrode.

5. The power-off discharging circuit according to claim 1, wherein the energy storage circuit comprises an energy storage capacitor, and wherein a first terminal of the energy storage capacitor is coupled to the first power supply voltage terminal, and a second terminal of the energy storage capacitor is coupled to the first terminal of the switching circuit and the output terminal of the control circuit.

6. The power-off discharging circuit according to claim 1, wherein the control circuit comprises a control thin film transistor, wherein a first electrode of the control thin film transistor is coupled to the first power supply voltage terminal, wherein a second electrode of the control thin film transistor is coupled to the first terminal of the energy storage circuit, wherein a gate of the control thin film transistor is coupled to the control signal terminal and is configured to turn on upon receiving an active control signal from the control signal terminal, and wherein the first electrode of the control thin film transistor comprises a first source or a first drain, and the second electrode of the control thin film transistor comprises a second drain or a second source corresponding to the first electrode.

7. The power-off discharging circuit according to claim 6, wherein a potential of the first power supply voltage terminal is configured to be pulled up to a high potential when the Xon function is enabled, so as to charge the energy storage circuit when the control thin film transistor is turned on, and configured to fall to a low potential when the Xon function ends, so as to discharge the energy storage circuit when the control thin film transistor is turned on.

8. The power-off discharging circuit according to claim 6, wherein the control circuit further comprises an auxiliary thin film transistor, wherein a first electrode of the auxiliary thin film transistor and a gate of the auxiliary thin film transistor are both coupled to the first power supply voltage terminal, wherein a second electrode of the auxiliary thin film transistor is coupled to the first terminal of the energy storage circuit, and wherein the first electrode of the auxiliary thin film transistor comprises a third source or a third drain, and the second electrode of the auxiliary thin film transistor comprises a fourth drain or a fourth source corresponding to the first electrode.

9. The power-off discharging circuit according to claim 8, wherein the potential of the first power supply voltage terminal is configured to be pulled up to a high potential when the Xon function is enabled, so as to charge the energy storage circuit when the auxiliary thin film transistor is turned on.

10. A gate driver, comprising:

a gate on array (GOA) unit; and the power-off discharging circuit according to claim 1, wherein the second terminal of the switching circuit of the power-off discharging circuit is coupled to a pull-up node of the GOA unit, and wherein the third terminal of the switching circuit is coupled to the first power supply voltage terminal of the GOA unit.

11. A display device, comprising the gate driver according to claim 10.

12. The display device according to claim 11, wherein the control circuit comprises a switching sub-circuit, wherein a first terminal of the switching sub-circuit and a third terminal of the energy storage circuit are both coupled to the first power supply voltage terminal, and a second terminal of the switching sub-circuit is coupled to the first terminal of the energy storage circuit, wherein the control circuit is further configured to control conductive connection or disconnection of the first terminal and the second terminal of the switching sub-circuit based on the control signal, and wherein when the switching sub-circuit is turned on, the control circuit is further configured to control the energy storage circuit to charge if the first power supply voltage terminal is at a high potential, and control the energy storage circuit to discharge if the first power supply voltage terminal is at a low potential.

13. The gate driver according to claim 10, comprising:

cascaded N GOA units which are the first GOA unit to the $N^{th}$ GOA unit, wherein N is an integer greater than or equal to 2.

14. The gate driver according to claim 13, wherein for the cascaded N GOA units, a signal input terminal of the first GOA unit is coupled to a frame start signal, and a reset signal terminal of the $N^{th}$ GOA unit is coupled to the frame start signal, wherein for the cascaded N GOA units, a signal input terminal of each of the second GOA unit to the $N^{th}$ GOA unit is coupled to an output terminal of an upper-stage GOA unit adjacent thereto, and wherein for the cascaded N GOA units, a reset signal terminal of each of the first GOA unit to the $N-1^{th}$ GOA unit is coupled to an output terminal of a next-stage GOA unit adjacent thereto.

15. The gate driver according to claim 14, wherein each of the N GOA units is coupled to a corresponding power-off discharging circuit, wherein a corresponding control signal terminal of the corresponding power-off discharging circuit coupled to the $i^{th}$ GOA unit comprises the output terminal of the $i-2^{th}$ GOA unit, wherein i takes a value of 3~N, and wherein the control signal terminals of the power-off discharging circuits coupled to the first GOA unit and the second GOA unit are coupled to a signal line terminal, one of output terminals of the GOA units or a preset control signal terminal.

16. The gate driver according to claim 14, wherein each of the N GOA units is coupled to a same power-off discharging circuit, and wherein the control signal terminal of the power-off discharging circuit comprises a signal line terminal, one of output terminals of the GOA units, or a preset control signal terminal.

17. A method of discharging via a power-off discharging circuit, the power-off discharging circuit comprising a control circuit, an energy storage circuit and a switching circuit, wherein an input terminal of the control circuit is coupled to a control signal terminal, an output terminal of the control circuit is coupled to a first terminal of the energy storage circuit, a second terminal of the energy storage circuit is coupled to a first terminal of the switching circuit, a second terminal of the switching circuit is coupled to a pull-up node of a gate driving circuit, and a third terminal of the switching circuit is coupled to a first power supply voltage terminal of the gate driving circuit, the method comprising:

controlling charging or discharging of the energy storage circuit based on a control signal input on the control signal terminal of the control circuit when an Xon function is enabled, wherein the Xon function is performed upon power-off to pull up the pull-up node and the first power supply voltage terminal to a high potential; and controlling conductive connection or disconnection of the second terminal and the third terminal of the switching circuit via the charging or the discharging of the energy storage circuit, so that the pull-up node and the first power supply voltage terminal are conductively-connected or disconnected, wherein the first power supply voltage terminal changes to a low potential after the Xon function ends, and wherein the energy storage circuit is configured to not conductively-connect the second terminal and the third terminal of the switching circuit via stored electrical energy until the Xon function ends.

18. The method according to claim 17, wherein the control signal is one of a plurality of signals on a signal line terminal in the gate driving circuit, an output terminal of the gate on array (GOA) unit, or a preset control signal terminal.

* * * * *